United States Patent [19]

Ritter et al.

[11] Patent Number: 4,774,824

[45] Date of Patent: Oct. 4, 1988

[54] APPARATUS FOR STRAIGHTENING SELF-HARDENING HOT-ROLLED WIRES AND FOR FEEDING THEM TO A CONSUMER

[75] Inventors: Gerhard Ritter; Klaus Ritter; Peter Fürndörfler, all of Graz, Austria

[73] Assignee: EVG Entwicklungs-U. Verwertungs-Gesellschaft M.B.H., Graz, Austria

[21] Appl. No.: 71,888

[22] Filed: Jul. 10, 1987

[30] Foreign Application Priority Data

Jul. 28, 1986 [AT] Austria ..... 2027/86

[51] Int. Cl.[4] ..... B21F 1/02

[52] U.S. Cl. ..... 72/5; 72/17; 72/160; 140/147

[58] Field of Search ..... 72/160, 4, 5, 17; 140/147; 192/125 A

[56] References Cited

U.S. PATENT DOCUMENTS

| | | | |
|---|---|---|---|
| 1,503,583 | 8/1924 | Gerrard et al. . | |
| 2,343,899 | 3/1944 | Groll et al. | 72/160 |
| 3,811,304 | 5/1974 | Gorker | 72/17 |
| 3,893,316 | 7/1975 | Simich | 140/147 |

FOREIGN PATENT DOCUMENTS

| | | |
|---|---|---|
| 187401 | 10/1956 | Austria . |
| 214241 | 3/1961 | Austria . |
| 1036198 | 8/1958 | Fed. Rep. of Germany . |
| 3120721 | 12/1982 | Fed. Rep. of Germany . |
| 719051 | 11/1954 | United Kingdom . |

*Primary Examiner*—Daniel C. Crane

*Attorney, Agent, or Firm*—Marmorek, Guttman & Rubenstein

[57] ABSTRACT

In an apparatus for feeding self-hardening hot rolled wires from supply reels to a consumer and for straightening the wires, in each feed path there is a rotor-type straightening device (3) with a straightening rotor (3*b*) deflecting the wire (1) radially between two fixed wire guides (3*a*) and rotating at high speed; the wire forms loops (12, 16), in front of and behind the rotor-type straightening device (3), the front loop (12) having assigned to it a sensing means (5, 8, 10) which switches off the rotor-type straightening device (3) when the length of this loop falls below a minimum value, while assigned to the rear loop (16) are two switches (18, 19) which, when a maximum or a minimum permitted length of this loop is reached, control the rotor-type straightening device (3) so as to correct the loop length.

9 Claims, 1 Drawing Sheet

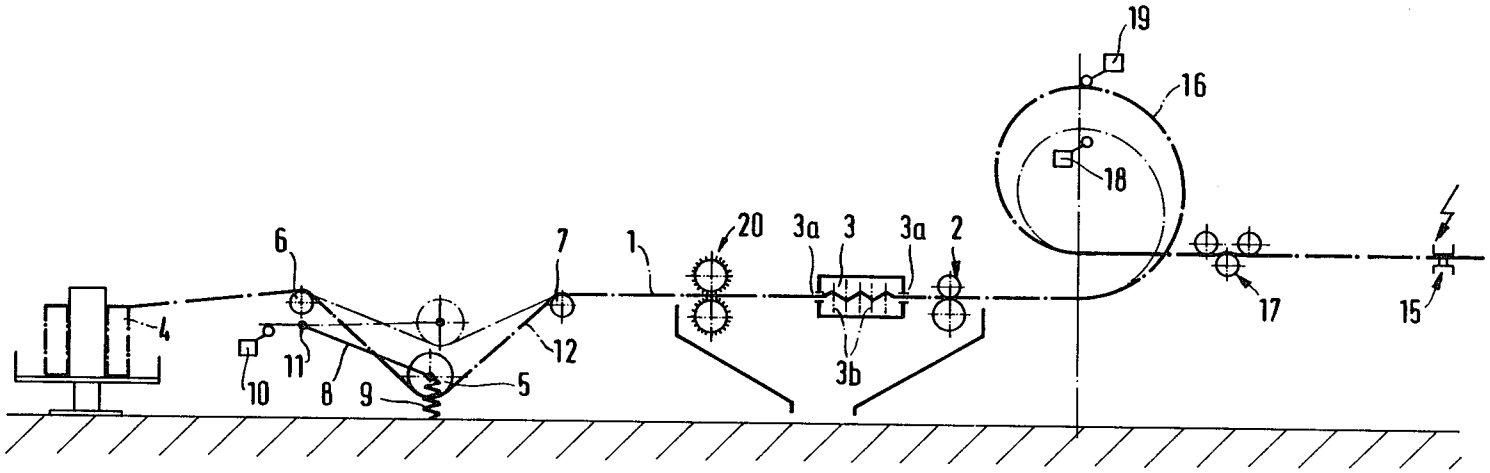
15
17
16
19
18
2
3a
3
3b
3a
20
1
7
12
5
9
8
6
11
10
4

APPARATUS FOR STRAIGHTENING SELF-HARDENING HOT-ROLLED WIRES AND FOR FEEDING THEM TO A CONSUMER

The invention relates to an apparatus for feeding self-hardening hot-rolled wires, drawn off from supply reels to a consumer, for example to a multi-spot resistance-welding machine, and for straightening the wires on their way from the supply reels to the consumer.

Hitherto, in the wire processing industry, especially where high wire strength values are required, such as, for example, in the production of welded-wire meshes for reinforced concrete construction, the wires made in a hot-rolling process have been subjected to subsequent cold forming, for example stretching, cold drawing or cold rolling, as a result of which their strength can be increased considerably. Since any hot-rolled unalloyed or low-alloy steel has a pronounced yield point, that is to say a load or stress limit, which, when exceeded, results in the steel expanding sharply without any additional increase in the load or stress, the stress permissible for the immediate use of such steel must be set below the yield point, in order to avoid deformations of the constructional parts when the yield point is reached. As a result of cold forming, not only are the flow properties of the steel eliminated, but its breaking strength is also improved. Thus, the strength properties of relatively low-alloy and easily weldable steels can be improved considerably. Moreover, steels pre-treated in this way have a smooth, clean surface which, for example, is beneficial in the welding together of intersecting wires to form welded meshes.

Such a process for producing meshes, in which all the operations were carried out in succession in one run, is known, for example, from Austrian Patent Specification No. 214,241.

Advances in steel production and decreasing prices of alloying materials make it possible, nowadays, to produce so-called self-hardening hot-rolled wires with strength properties corresponding to those of cold-formed wires, at prices which are very competitive in relation to those of cold-formed wires. Nor does the welding of self-hardening hot-rolled high-alloy wires present difficulties any longer today, because, in order to achieve high strengths, instead of carbon which has an adverse effect on welding, other alloying elements are available at moderate cost and are used.

However, when self-hardening hot-rolled wires are used, the straightening operation becomes relatively difficult, especially since, where cold-formed wires are concerned, the most pronounced deformations are already smoothed out as a result of the cold-working operation. Consequently, to straighten cold-drawn wires it is possible to use simple roller-type straightening devices generally consisting of two sets of rollers which are arranged at rightangles to one another and through which the wire is guided in each case in one plane, slightly wavy to an extent decreasing towards the outlet side of the set of straightening rollers.

Substantially better straightening results, which are therefore particularly favourable for self-hardening hot-rolled steels, can be obtained with a so-called rotor-type straightening device, in which the wire is deflected in a straightening rotor, between two fixed wire guides lying in the wire drawing axis, by means of a wire guide which rotates at high speed about this axis. An embodiment of such a rotor-type straightening device is described in Austrian Patent Specification No. 187,401.

Since a high flywheel effect is naturally inherent in such straightening devices because of the necessary high speed of the straightening rotor, they cannot be switched off suddenly, and consequently the wire, if it is not fed uniformly, for example because drivers of the supply reels, from which the wire is drawn off, have fouled, tends to become twisted to such an extent that it breaks. Moreover, on the outlet side of the straightening device there must be a possibility of ensuring that the emergence of the wire, occuring at uniform speed, is synchronized with the usually intermittent drawing of the wire into a consumer, for example a mesh-welding machine, and at the same time it must be remembered that satisfactory straightening of the wire presupposes a specific ratio of the rotational speed of the straightening rotor to the advancing speed of the wire through the straightening rotor.

It is known from DE-A-3,120,721 to ensure a faultless feed of a wire advanced at uniform speed to an intermittently operating consumer by means of a wire loop of variable length, the maximum and minimum lengths of which are limited by two proximity switches connected operatively to the drive mechanism of the wire. Depending on whether the wire loop actuates the switch limiting its minimum length or that limiting its maximum length, the advancing speed of the wire is increased or reduced. Furthermore, for example, DE-B-1,036,198 also makes known devices which stop a wire-processing consumer, as soon as its feeding with wire is disrupted or interrupted for any reason. Other devices known, for example, from GB-A-719,051 or U.S. Pat. No. 1,503,583 trigger the severing of the wire when the wire tension between the run-off device and the consumer exceeds a predetermined value. This effect is equivalent in its reprecussions to a wire break.

Starting from this state of the art, the object of the invention is to design an apparatus for feeding self-hardening hot-rolled wires to a consumer, in such a way that wire breaks are avoided when the wire feed to the straightening device is suddenly interrupted, or in such a way as to ensure that the wire emerging from the straightening device at uniform speed is transferred perfectly to a consumer operating intermittently.

By means of an apparatus of the type mentioned in the introduction, in which a wire loop of variable length is arranged in a known way between each supply reel and the consumer, with two stitches assigned to this wire loop and capable, when a maximum or a minimum loop length is reached, of influencing the conveying speed of a draw-off device in order to correct the loop length, this object is achieved, according to the invention, because, between this first wire loop and the supply reel, there is, in front of the draw-off device, a rotor-type straightening device known per se, deflecting the wire radially between two wire guides lying in the wire drawing axis, by means of a straightening rotor rotating at high speed, and between the rotor-type straightening device and the reel there is a second loop of variable length; and because this second loop has assigned to it a sensing means which, when the length of the second loop falls below a predetermined minimum value, is capable of switching off at least the draw-off device and the rotor-type straightening device, whilst the switches assigned to the first loop are capable of influencing not only the conveying speed of the draw-off device, but also the speed of the rotor-type straightening device in the same direction.

The invention will now be described in detail with reference to an exemplary embodiment which is illustrated diagramatically in the drawing and which shows the path followed by a wire from the supply reel to the consumer.

Each wire 1 running off from a supply reel 4 mounted so as to be freely rotatable is conveyed through a rotor-type straightening device 3 by means of a motor-driven pair of draw-off rollers 2 grasping it in a pinching hold. The straightening device 3 has, in the wire drawing axis, two wire guides 3*a* and between these a straightening rotor 3*b* which deflects the wire out of the wire drawing axis several times and which rotates at high speed.

Between the rotor-type straightening device 3 and the reel 4, the wire is deflected out of the straight feed direction by a spring-loaded roller 5 arranged between two stationary rollers 6 and 7 and mounted on one arm of a two-armed lever 8 mounted rotatably at 11, so that the wire normally forms a loop-like bulge 12 of predetermined size. The spring 9 loading the roller 5 must be sufficiently strong to be capable of absorbing the force in the wire 1, necessary for rotating the reel 4 in normal operation, without any appreciable reduction in the wire sag between the rollers 6 and 7.

Only in the event of a fault when the rotation of the supply reel 4 is impeded, for example because two drivers of the wire wound on the reel catch in one another, is the wire gradually tensioned between the rollers 6 and 7. The free arm of the two-armed lever 8 thereby comes up against a switch contact 10, by means of which at least the drive of the rotor-type straightening device 3 and of the associated pair of draw-off rollers 2 is switched off and, at the same time, braking the straightening rotor 3*b* is initiated. Since the wire 1 still deviates considerably from the tangent line of the two rollers 6 and 7 at the beginning of the braking action, it may, by means of general stretching, be conveyed slightly further between the rollers 6 and 7 while the straightening rotor 3*b* is slowing down, thereby avoiding, by means of the straightening rotor 3*b*, a local overloading of the wire which would lead to a break.

Between each rotor-type straightening device 3 and the consumer 15, for example a mesh-welding machine, which is illustrated only diagrammatically, a further loop 16 is arranged, which is followed by a roller-type straightening device 17 having the object of merely removing remaining deformations which have resulted from the loop 16.

The size of the loop 16 is limited by means of two switches 18, 19. The switches 18, 19 affect the rotor-type straightening device 3 in such a way that the drive of the straightening rotor 3*b* and the drive of the pair of draw-off rollers 2 is switched to a higher speed level when the switch 18 is operated, and to a contrastingly lower speed level when the switch 19 is operated.

The switch 18 can also be designed in such a way that when the straightening rotor 3*b* does not respond to the switch operation, for example because the straightening rotor 3*b* has been switched off and braked by operation of the contact 10, it effects a switching off of the consumer 15 in a second switch position. On the other hand, the switching off of the consumer 15 could also proceed directly from the switch contact 10.

Since the hot-rolled wires are scaled, so that they can be processed more effectively the rotor-type straightening device 3 can also be preceeded by a descaling device 20, for example a motor-driven set of brushes.

Finally, since each rotor-type straightening device twists the wire on itself to a certain extent during the straightening operation, with the result that internal stresses are built up in the wire during straightening, it may be considered expedient, when a plurality of wires are fed to the consumer, to drive at least some rotor-type straightening devices in the opposite direction of rotation to the other rotor-type straightening devices, in order to ensure compensation of the torsional stresses of adjacent wires in an end product, for example a welded mesh.

We claim:

1. Apparatus for feeding and straightening a self-hardening, hot-rolled wire, comprising a supply reel for supplying a wire and a wire consumer for receiving said wire after it has been straightened, said supply reel being freely rotatable, draw-off means for drawing said wire from said supply reel along a wire drawing path, said draw-off means being operable at a variable speed, rotary straightening means located upstream of said draw-off means for straightening said wire, said rotary straightening means being operable at a variable speed, said rotary straightening means including first and second wire guides lying in the drawing path and a straightening rotor for radially deflecting said wire between said first and second wire guides, means for forming a first wire loop of variable length located between said supply reel and said wire consumer, said first wire loop forming means being located downstream of said draw-off means, first and second switch means associated with said first wire loop forming means for sensing the length of said first wire loop, said first and second switch means controlling the operating speed of said draw-off means in order to maintain the length of said first wire loop between predetermined maximum and minimum values, said first and second switch means also controlling the operating speed of said rotary straightening means, means for forming a second wire loop of variable length located upstream of said rotary straightening means, and sensing means associated with said second wire loop forming means for sensing the length of said second wire loop, said sensing means switching off said draw-off means and said rotary straightening means when the length of said second loop falls below a predetermined minimum value.

2. Apparatus for feeding and straightening multiple self-hardening, hot-rolled wires comprising an apparatus in accordance with claim 1 associated with each of said wires, at least some of said rotary straightening means being driven in a direction opposite to the rotation of others of said rotary straightening means.

3. Apparatus according to claim 1 wherein said sensing means is operative to switch off said wire consumer.

4. Apparatus according to claim 1 wherein one of said first and second switch means is operative to switch off said wire consumer in the event said draw-off means and said rotary straightening means fail to respond to a command triggering an increase in size of said first loop.

5. Apparatus according to claim 1 furthering comprising descaling means located upstream of said rotary straightening means.

6. Apparatus according to claim 1 wherein said means for forming a second wire loop comprises a spring loaded roller and a two-armed lever for actuating said sensing means.

7. Apparatus according to claim 1 further comprising second rotary straightening means located downstream of said first wire loop forming means.

8. Apparatus according to claim 1 wherein said draw-off means is located between said rotary straightening means and said first wire loop forming means.

9. Apparatus according to claim 1 wherein said straightening rotor includes means for deflecting said wire out of said drawing path multiple times.

* * * * *